US011058600B1

(12) United States Patent
Archer

(10) Patent No.: US 11,058,600 B1
(45) Date of Patent: Jul. 13, 2021

(54) STIMULATION DEVICE

(71) Applicant: Vanessa Archer, Coral Gables, FL (US)

(72) Inventor: Vanessa Archer, Coral Gables, FL (US)

( * ) Notice: Subject to any disclaimer, the term of this patent is extended or adjusted under 35 U.S.C. 154(b) by 116 days.

(21) Appl. No.: 15/978,721

(22) Filed: May 14, 2018

(51) Int. Cl.
*A61H 19/00* (2006.01)
*A61H 23/02* (2006.01)

(52) U.S. Cl.
CPC ..... *A61H 19/50* (2013.01); *A61H 19/34* (2013.01); *A61H 19/44* (2013.01); *A61H 23/02* (2013.01); *A61H 2201/1652* (2013.01)

(58) Field of Classification Search
CPC .. A61H 19/44; A61H 2201/165; A61H 19/34; A61H 19/50
See application file for complete search history.

(56) References Cited

U.S. PATENT DOCUMENTS

| | | | | |
|---|---|---|---|---|
| 5,690,603 | A | 11/1997 | Kain | |
| 5,853,362 | A | 12/1998 | Jacobs | |
| 6,991,599 | B2 | 1/2006 | Hudson | |
| 7,998,057 | B2 | 8/2011 | Kain | |
| 8,496,572 | B2 | 7/2013 | Lee | |
| 8,911,349 | B2 | 12/2014 | Jackson | |
| 2002/0188233 | A1 | 12/2002 | Denyes | |
| 2009/0234182 | A1 | 9/2009 | Buchholz | |
| 2011/0034763 | A1 | 2/2011 | Domnick et al. | |
| 2014/0357943 | A1 | 12/2014 | Greaves | |
| 2017/0087049 | A1 | 3/2017 | Hutchison | |
| 2017/0333282 | A1* | 11/2017 | Swartz | A61H 19/44 |

OTHER PUBLICATIONS lovehoney.com—"Fetish Fantasy Double Delight Vibrating Double Dildo Strap-On Set"—www.lovehoney.com/product.cfm?p=29012—Publication Date: Nov. 22, 2013.

amazon.com—"Rabbit Vibrator for Vagina/G Spot Stimulator/Clit/Anal Play"—www.amazon.com/Rabbit-Vibrator-Vagina-Spot-Stimulator/dp/B01DGHX2OE/ref=pd_lpo_vtph_121_lp_t_3?_encoding=UTF8&refRID=ZW5X83CC43SNY56ANYBJ&th=1—Date Accessed: Oct. 10, 2009 (Publication date not found on archive.org).

* cited by examiner

*Primary Examiner* — Christine H Matthews
(74) *Attorney, Agent, or Firm* — Lott & Fischer, PL

(57) ABSTRACT

A stimulation device is provided including a central portion having first and second opposite ends, a first shaft, and a second shaft. The first shaft and the second shaft extend from the first opposite end and the second opposite end, respectively. The central portion may further include one or more stimulation tips that may be integrated with the central portion or may extend from the central portion. The one or more stimulation tips may provide a pleasurable vibrating motion or pulsating sensation to the clitoral region of a female's vagina. The shafts may provide a pleasurable vibrating motion or pulsating sensation to the vagina or anus of a female. Upon insertion of the shafts into each respective female's vagina or anus, the stimulation device may serve to align the vulva or anus of the two females and influence their motion with respect to one another. Accordingly, upon penetration of the vulva or anus, the clitoral region of the first and second female may come in contact with the one or more stimulation tips, facilitating simultaneous stimulation.

18 Claims, 17 Drawing Sheets

STIMULATION DEVICE

FIELD OF INVENTION

The invention relates generally to sexual stimulation devices and in particular to a device that provides simultaneous sexual stimulation to the genitalia of two sexual partners.

BACKGROUND OF THE INVENTION

Various devices are commercially available to provide sexual stimulation to a human's genitalia. Of these devices, simulated penises (commonly known as "dildos") and vibrators are the most common devices used to achieve sexual stimulation of internal or external genitalia. Although these devices are typically used for sexual stimulation, they may also be used for the purpose of developing, strengthening, tightening or otherwise enhancing the function of muscles, glands, and other organs surrounding the vagina, urethra, or anus. Further, these devices may also be used for other purposes such as contraception, avoidance of sexually transmitted diseases, disability, or temporary fatigue.

Dildos are generally phallic shaped devices that are used to simulate sexual intercourse. In use, dildos are inserted into the vagina or anus, either by the individual user or a partner, using suitable lubrication if required. They provide stimulation from friction upon manipulation of the device, or by pressure from the expansion of the vaginal or anal cavity due to the size or volume of the device.

Alternatively, vibrators utilize electrical power to provide a pulsating or vibrating sensation to a human's genitalia. Vibrators may also be phallic shaped and are often times confused with dildos. With respect to females, vibrators are often designed to target specific areas of the vagina, such as the clitoris or the paraurethral gland of the urethral sponge of the clitoris (also called the Gafenberg spot or G-spot).

The clitoris is a female sex organ near the labia minora of the vulva, above the opening of the urethra. The clitoris is estimated to have more than 8,000 sensory nerve endings. Due to the abundance of nerve endings, the clitoris is believed to be the female's most sensitive erogenous zone and the primary source of female sexual pleasure. Stimulation of the clitoris can produce sexual arousal and orgasm.

The Gafenberg spot or G-spot is an area of the anterior wall of the vagina between the vaginal opening and the urethra (typically reported to be about two inches from the vagina opening). The existence of the G-spot has not been proven; however, it is believed that stimulation of the G-spot may lead to sexual arousal, powerful orgasms, and potential female ejaculation.

Through use of the aforementioned devices, females usually need direct clitoral stimulation, such as applying a vibrating or pulsating sensation to the clitoris, in order to orgasm. G-spot stimulation may be best achieved by using vaginal penetration; however, the level of vaginal penetration required depends on the female's specific anatomy. The effects of G-spot stimulation when using a dildo or vibrator may be enhanced by additionally stimulating other erogenous zones on a female's body, such as the clitoris or vulva as a whole.

Although dildos and vibrators are generally designed for self-stimulation or the stimulation of one partner only, partners may use dildos or vibrators to give sexual pleasure to each other. However, partners who choose to use a dildo or vibrator in mutual sexual activity may face several difficulties such as, difficulty of use, the lack of a face-to-face sexual experience, and the lack of simultaneous clitoral and vaginal stimulation for both partners.

Accordingly, the current invention aims to provide a stimulation device that enables a face-to-face sexual experience that enhances and facilitates an orgasm between two sexual partners by providing simultaneous sexual stimulation of the vagina or anus of the partners.

SUMMARY OF THE INVENTION

The following summary is provided to introduce a selection of concepts in a simplified form that are further described below in the detailed description. This summary is not intended to identify key features or essential features of the claimed subject matter, nor is it intended to be used to limit the scope of the claimed subject matter.

The present disclosure is directed to a sexual stimulation device that provides simultaneous sexual stimulation to the vagina and/or anus of two sexual partners.

According to one implementation, the stimulation device includes a central portion having first and second opposite ends, a first shaft, and a second shaft. The first shaft and the second shaft extend from the first opposite end and the second opposite end, respectively. Upon insertion of the shafts into one or more female users' vagina or anus, the central portion is configured to come into contact with the perineal raphe region, anal region, and/or clitoral region of the genitalia of the one or more female users. The central portion may further include one or more stimulation tips that may be integrated with the central portion or may extend from the central portion. The one or more stimulation tips may provide a pleasurable vibrating motion or pulsating sensation to the clitoral region of a female's vagina.

The shafts may provide a pleasurable vibrating motion or pulsating sensation to the vagina or anus of a female. The shape of the shafts may be cylindrical or generally phallic to simulate a human penis. Upon insertion of the shafts into each respective female's vagina, the stimulation device may serve to align the vulva or anus of the two females and influence their motion with respect to one another. Accordingly, upon penetration of the vulva or anus, the clitoral region of the first and second female may come in contact with the one or more stimulation tips. Therefore, in addition to the simultaneous indirect clitoral stimulation created by the internal motion of vaginal and/or anal thrusting, the stimulation device facilitates simultaneous direct stimulation of the clitoris of the first female and the second female by aligning and stabilizing the relative motions of the vulvas of both females.

These and other features and advantages will be apparent from a reading of the following detailed description, and a review of the appended drawings. It is to be understood that the foregoing summary, the following detailed descriptions, and the appended drawings are only explanatory and are not restrictive of various aspects claimed.

Although the invention is illustrated and described herein as embodied in stimulation device, it is nevertheless not intended to be limited to only the details shown, since various modifications and structural changes may be made therein without departing from the spirit of the invention and within the scope and range of equivalents of the claims.

DETAILED DESCRIPTION OF THE INVENTION

Figure 1A:
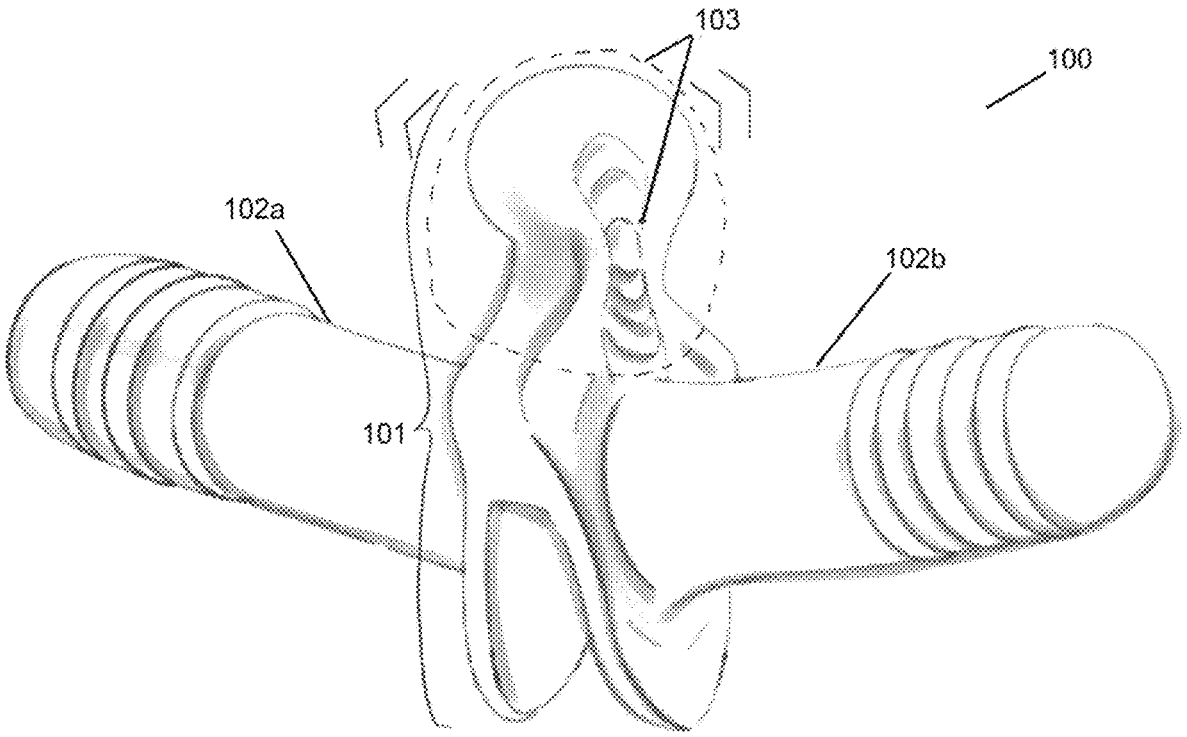
FIG. 1A is a perspective view of a stimulation device in accordance with an implementation of the invention.
Figures 1B, 1C:
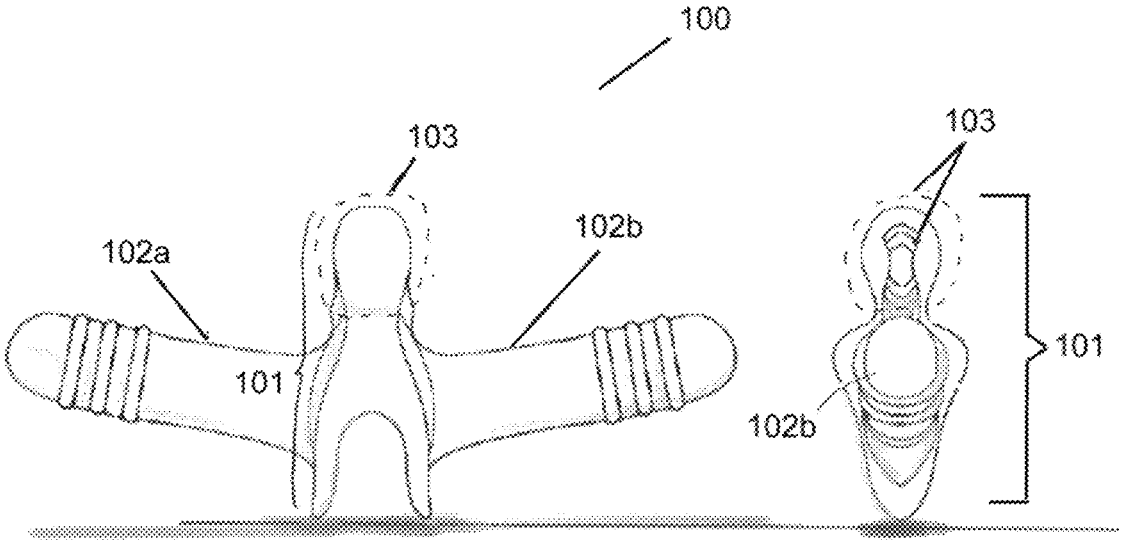
FIG. 1B is a side view of the stimulation device in accordance with an implementation of the invention.
FIG. 1C is a frontal view of the stimulation device in accordance with an implementation of the invention.

As illustrated in FIGS. 1A-1C, an example implementation of a stimulation device 100 is shown including a central portion 101 having first and second opposite ends, a first shaft 102*a*, and a second shaft 102*b*. The first shaft 102*a* and the second shaft 102*b* extend from the first opposite end and the second opposite end, respectively. Both first opposite end and second opposite end refer to general areas and not to specific component parts. Further, the stimulation device 100 may be bilaterally symmetrical, therefore, the first opposite end and the second opposite end are synonymous, and the use of the terms "first" or "second" are only used for the sake of clarity and to denote their use with respect to a "first" or "second" female user. However, in this example implementation, the first opposite end is depicted as the left side of the central portion 101, while the second opposite end is depicted as the right side of the central portion 101.

In a preferred implementation, the body of the central portion 101 may be generally "Y" shaped; however the body of the central portion 101 is not limited to any particular shape, and may be rectangular, square, round, octagonal, trapezoidal, hexagonal or oval, among other shapes. Upon insertion of shafts 102*a*, 102*b* into one or more female users' vagina or anus, the central portion 101 is configured to come into contact with the perineal raphe region, anal region, and/or clitoral region of the genitalia of the one or more female users. The outer surface (or periphery) of the central portion 101 may include one or more textured surfaces, such as nubs, ribs, protrusions, etc., intended to provide greater stimulation when contacted with a female's vagina or anus. The central portion 101 may be made of a waterproof material. Further, the central portion 101 may be made of a rigid material such as glass, metal, wood, plastic, or the like. Alternatively, the central portion 101 may be made of a pliable material, such as a rubber or suitable plastic, to allow for flexibility and comfort upon usage of the stimulation device and insertion of shaft 102*a*, 102*b* into the vagina or anus of one or more female users. For example, the central portion may be made of a polymer such as polyuria, or surgical-grade silicone. Additionally, the central portion may be made of a pliable ultra-moisturizing, paraben free, glycerin free, and fragrance free material.

In a preferred implementation, the central portion 101 is constructed with platinum-catalyzed (platinum-cure) silicone. Platinum-cure silicone will not breakdown, deform, or lose its elasticity over time. Platinum-cure silicone requires pure pigments free of additives or potentially toxic metals like lead, aluminum, cadmium or mercury. Platinum-cure silicone releases no toxic byproducts before, during, or after cure, and the bonds formed are completely stable and non-reactive. Platinum-cure silicone releases no toxic compounds when mixed, has zero smell or outgassing, and is completely non-toxic.

The central portion 101 may further include one or more stimulation tips 103 that may be integrated with the central portion 101 or may extend from the central portion 101. The one or more stimulation tips 103 may provide a pleasurable vibrating motion or pulsating sensation to the clitoral region of a female's vagina. In an additional implementation, the one or more stimulation tips 103 may be adapted to adjust temperature to provide a pleasurable heating or cooling sensation to the clitoral region of a female's vagina. In a further implementation, the one or more stimulation tips 103 may be adapted to rotate in a circular motion to provide a pleasurable sensation to the clitoral region of a female's vagina. In yet another implementation, the one or more stimulation tips 103 may have one or more apertures adapted to release a lubricant or another type of fluid to provide an additional pleasurable sensation to the clitoral region of a female's vagina.

In a preferred implementation, as shown in FIGS. 1A-1C, the stimulation tip 103 is integrated with the central portion 101 and has a diameter of 2 inches and a height of 4 inches. However, the one or more stimulation tips 103 may vary in length, height, width, diameter, or any measurable dimensions. In a further implementation, the one or more stimulation tips 103 may be releasably attached to the central portion 101 of the stimulation device and permit the use of differently shaped and sizes of stimulation tips 103.

The one or more stimulation tips 103 may be substantially spherical; however the one or more stimulation tips 103 are not limited to any particular shape, and may be rectangular, square, round, octagonal, trapezoidal, hexagonal or oval, among other shapes. The outer surface (or periphery) of the one or more stimulation tips 103 may include one or more textured surfaces, such as nubs, ribs, protrusions, etc., intended to provide greater stimulation when contacted with a female's clitoris. The one or more stimulation tips 103 may be made of a waterproof material. Further, the one or more stimulation tips 103 may be made of a rigid material such as glass, metal, wood, plastic, or the like. Alternatively, the one or more stimulation tips 103 may be made of a pliable material, such as a rubber or suitable plastic, to allow for flexibility and comfort upon usage of the stimulation device 100. For example, the one or more stimulation tips 103 may be made of a polymer such as polyuria, or surgical-grade silicone. Additionally, the one or more stimulation tips may be made of a pliable ultra-moisturizing, paraben free, glycerin free, and fragrance free material. In a preferred implementation, the one or more stimulation tips are constructed with platinum-catalyzed (platinum-cure) silicone. Still referring to FIGS. 1A-1C, a first shaft 102*a* and a second shaft 102*b* have an elongated shape and extend from the first opposite end and the second opposite end, respectively. As explained above, the stimulation device 100 is bilaterally symmetrical, therefore, the first shaft 102*a* and the second shaft 102*b* are synonymous, and the use of the terms "first" or "second" are only used for the sake of clarity and to denote their use with respect to a "first" or "second" female user. However, in this example implementation, the first shaft 102*a* is depicted as the left shaft, while the second shaft 102*b* is depicted as the right shaft.

Shafts 102*a*, 102*b* may provide a pleasurable vibrating motion or pulsating sensation to the vagina or anus of a female. In an additional implementation, shafts 102*a*, 102*b* may be adapted to adjust temperature to provide a pleasurable heating or cooling sensation to the vagina or anus of a female. In a further implementation, shafts 102*a*, 102*b* may have one or more apertures adapted to release a lubricant or another type of fluid to provide an additional pleasurable sensation to the vagina or anus of a female. The shape of shafts 102*a*, 102*b* may be cylindrical or generally phallic to simulate a human penis; however shafts 102*a*, 102*b* are not limited to any particular shape, and shafts 102*a*, 102*b* may be any shape that would provide stimulation or pleasure to a female user. Shafts 102*a*, 102*b* may incorporate design features imitative of a wide range of natural, mechanical, and imaginary objects, e.g. vegetables such as a cucumber or zucchini, a human finger, a rocket ship; or the design may be more abstract. In a preferred implementation, as shown in FIGS. 1A-1C, the first shaft 102*a* and the second shaft 102*b* are 6 inches in length. However, the first shaft 102*a* and the second shaft 102*b* may vary in length, height, width, diameter, or any measurable dimensions.

Figure 1D:
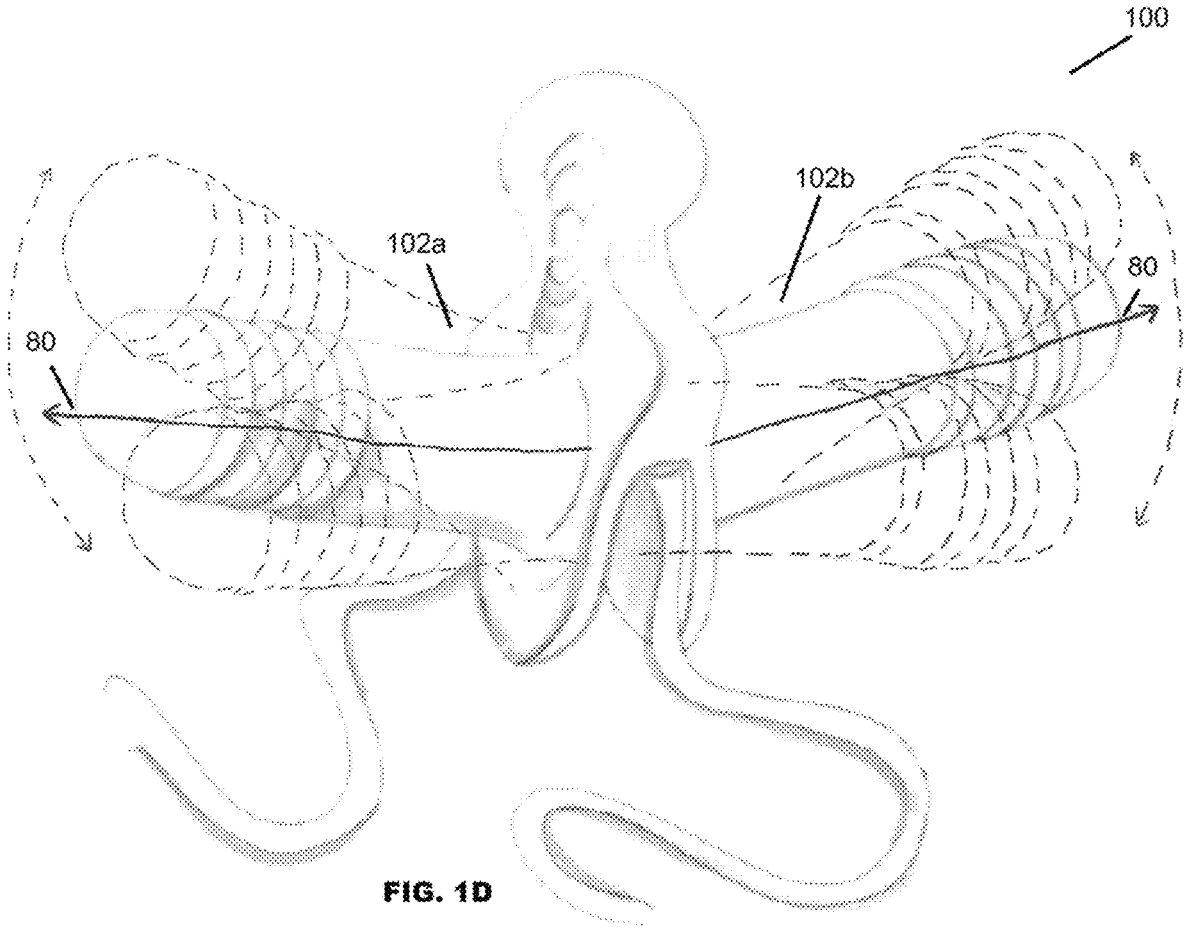
FIG. 1D is a perspective view of the stimulation device showing the flexibility of the shafts in accordance with an implementation of the invention.
Figure 1E:
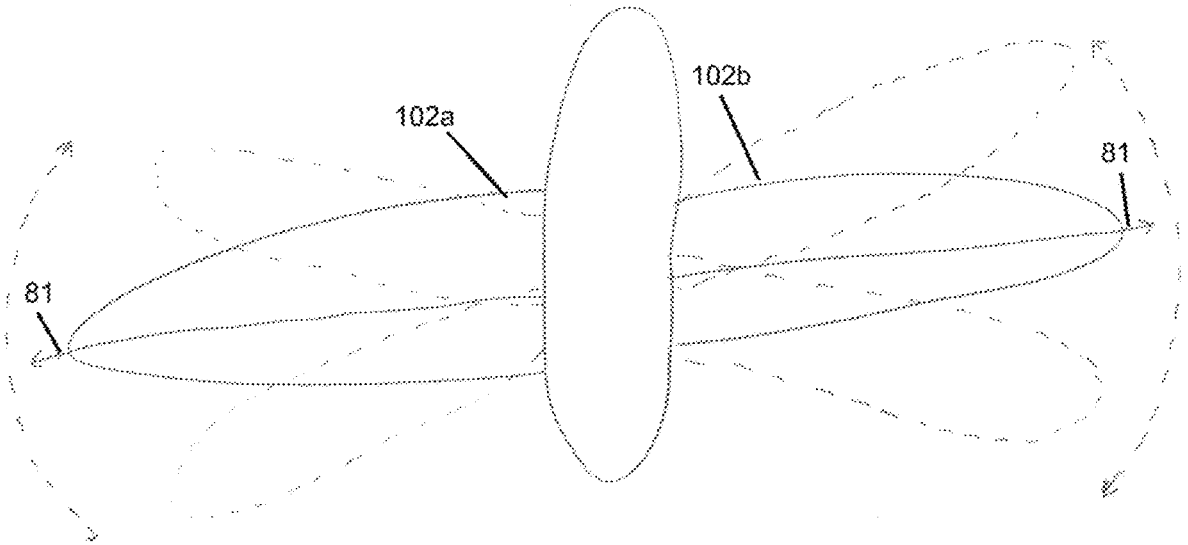
FIG. 1E is an aerial view of the stimulation device showing the flexibility of the shafts in accordance with an implementation of the invention.

The outer surface (or periphery) of shafts 102*a*, 102*b* may include one or more textured surfaces, such as nubs, ribs, protrusions, etc., intended to provide greater stimulation when inserted into a female's vagina or anus. Shafts 102*a*, 102*b* may be made of a waterproof material. Further, Shafts 102*a*, 102*b* may be made of a rigid material such as glass, metal, wood, plastic, or the like. Alternatively, Shafts 102*a*, 102*b* may be made of a pliable material, such as a rubber or suitable plastic, to allow for flexibility and comfort upon usage of the stimulation device 100 and insertion of shafts 102*a*, 102*b* into a vagina or anus. For example, shafts 102*a*, 102*b* may be made of a polymer such as polyuria, or surgical-grade silicone. In one implementation, as shown in FIG. 1D, shafts 102*a*, 102*b* are rotatable about an axis (shown as solid line 80) from 0 degrees to 90 degrees. In a further implementation, as shown in FIG. 1E, shafts 102*a*, 102*b* are rotatable about an axis (shown as solid line 81) from 45 degrees to 90 degrees. The pliability of shafts 102*a*, 102*b* may allow the user to configure shafts 102*a*, 102*b* in an orientation that would facilitate greater sexual arousal of the G-spot. Additionally, shafts 102*a*, 102*b* may be made of a pliable ultra-moisturizing, paraben free, glycerin free, and fragrance free material. In a preferred implementation, the shafts 102*a*, 102*b* are constructed with platinum-catalyzed (platinum-cure) silicone.

The first shaft 102*a* and the second shaft 102*b* are removable, and the central portion 101 may be configured to accept shafts of various sizes and configurations. Shafts 102*a*, 102*b* may be coupled to the central portion 101 by a threaded configuration, friction-fit arrangement, or with hardware such as fasteners, clamps, clasps, or the like.

In use, the example implementation of the stimulation device 100 shown in FIGS. 1A-1C may be utilized with one or more female users. A first female user may stimulate herself by inserting the first shaft 102*a* into her vagina or anus and maintaining contact of her clitoral region with the one or more stimulation tips 103. Additionally, the first female may stimulate herself by inserting the first shaft 102*a* into her vagina or anus and repeatedly thrust the first shaft 102*a* into and out of her vagina or anus. Alternatively, a first female user may stimulate herself and a second female simultaneously by inserting the first shaft 102*a* into her vagina or anus, and subsequently, undulating her hips to cause the second shaft 102*b* to thrust into and out of the second female's vagina or anus. The stimulation device 100 thus provides stimulation and sexual pleasure simultaneously to both the first female and the second female through thrusting, resultant friction, and sensations emitted by the one or more stimulation tips 103.

Upon insertion of shafts 102*a*, 102*b* into each respective female's vagina or anus, the stimulation device 100 may serve to align the vulva or anus of the two females and influence their motion with respect to one another. Accordingly, upon penetration of the vulva or anus, the clitoral region of the first and second female may come in contact with the one or more stimulation tips 103. Therefore, in addition to the simultaneous indirect clitoral stimulation created by the internal motion of vaginal and/or anal thrusting, the stimulation device 100 facilitates simultaneous direct stimulation of the clitoris of the first female and the second female, and also of other sensitive external tissues such as the labia majora and labia minora, by aligning and stabilizing the relative motions of the vulvas of both females.

The stimulation device 100 facilitates a face-to-face sexual experience by aligning the bodies of the first and second female vagina-to-vagina, anus-to-anus, clitoris-to-clitoris, etc., which is unlike the positioning attained if one female is wearing a strap-on pelvic mounted dildo. However, in additional implementations shown in FIGS. 2A-2B, the stimulation device 100 may include one or more adjustable straps to secure the stimulation device 100 onto the first or second female during simultaneous use or to allow the stimulation device 100 to be used as a strap-on pelvic mounted dildo.

Figure 2A:
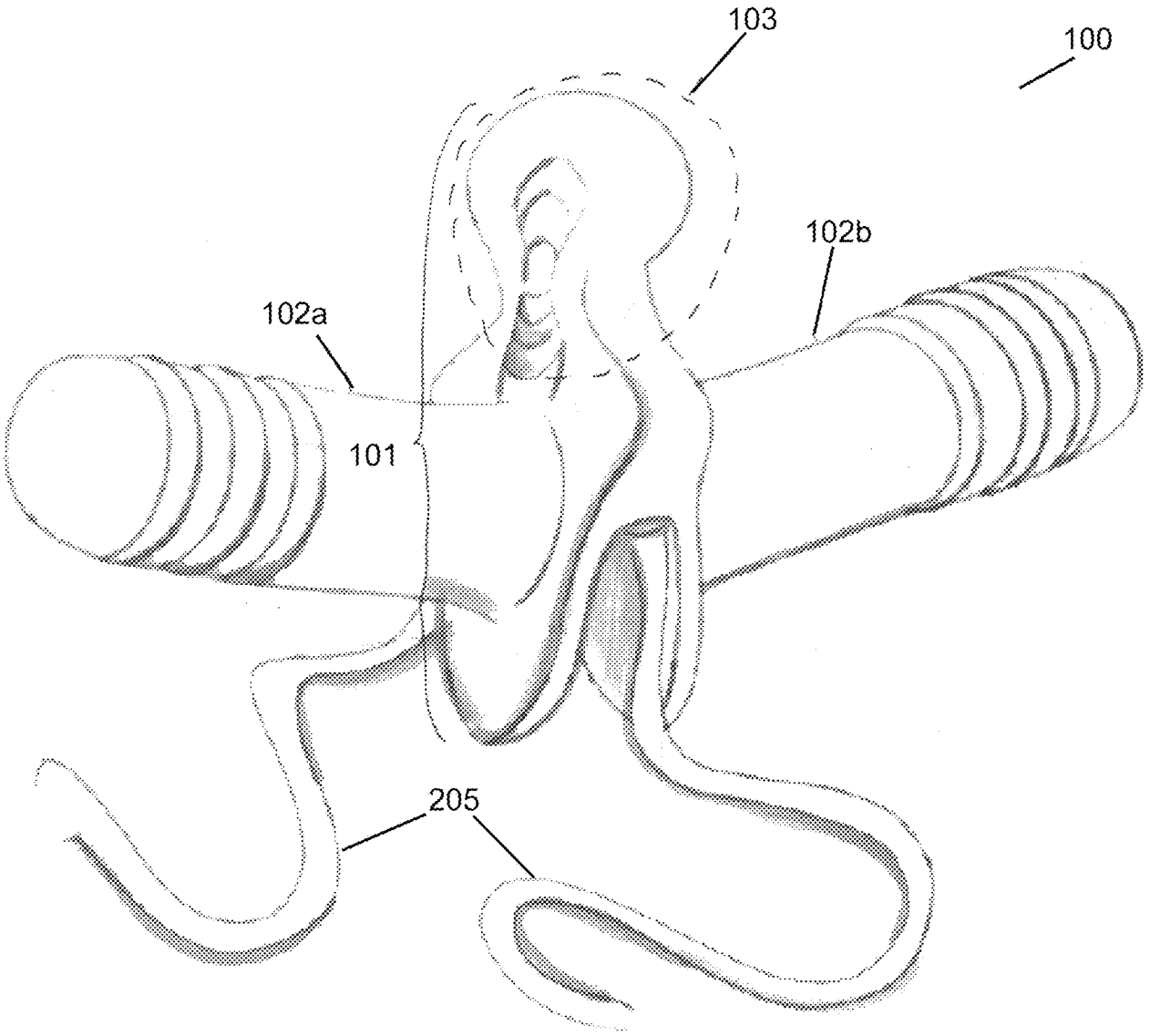
FIG. 2A is a perspective view of the stimulation device including adjustable straps in accordance with an implementation of the invention.

FIG. 2A illustrates an example implementation of the stimulation device 100 that may include one or more adjustable straps 205. The one or more adjustable straps 205 may be coupled to and extend from the central portion 101 of the stimulation device 100. In another implementation, the stimulation device 100 may have one or more fasteners (not shown), preferably positioned at the central portion 101, which accept one or more adjustable straps 205. The adjustable straps may be made of nylon, Velcro, rubber (elastic band), plastic, or the like. The one or more fasteners may be a buckle, clip, clasp, Velcro mechanism, interlocking loop mechanism, or the like.

Figure 2B:
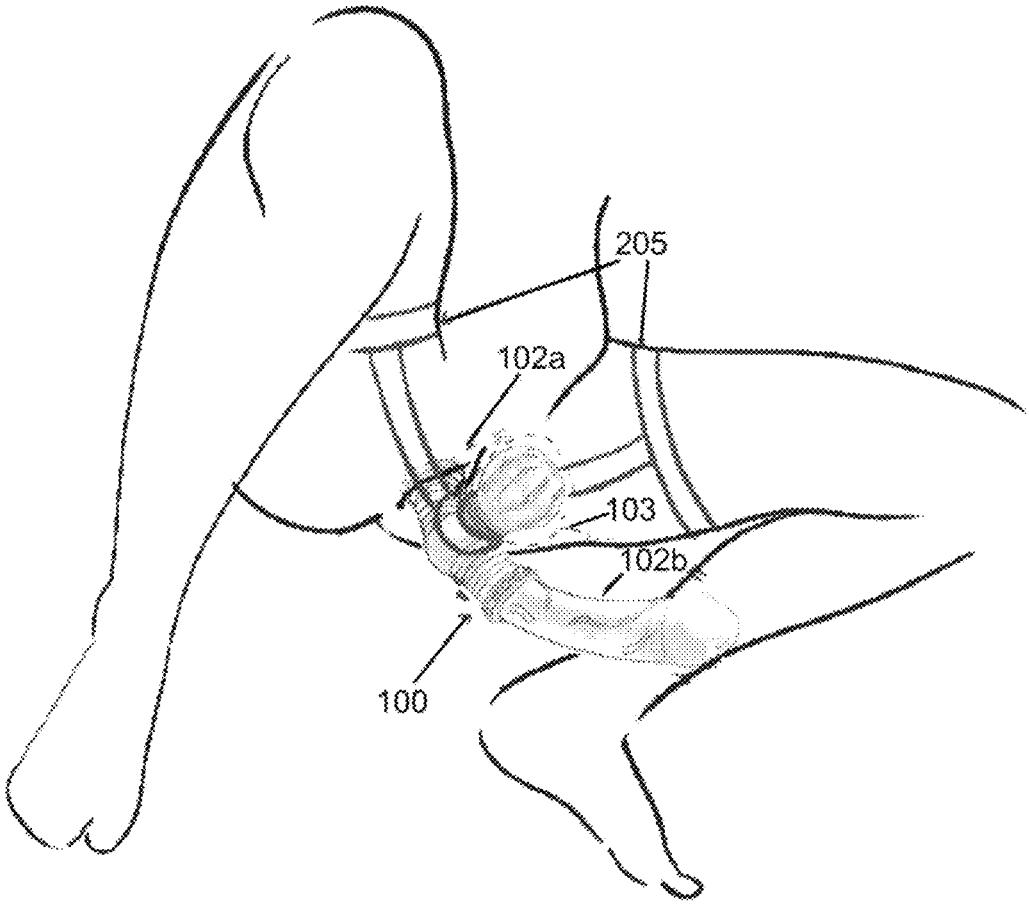
FIG. 2B is a perspective view of the stimulation device applied to a user via the adjustable straps in accordance with an implementation of the invention.

FIG. 2B illustrates the one or more adjustable straps 205 in use in accordance with the example implementation described above with respect to FIG. 2A. The adjustable straps 205 may be secured about the thigh of the first or second female's leg. The adjustable straps 205 support the stimulation device 100 so that, upon insertion of the first shaft 102*a* into the first female's vagina or anus, the first shaft 102*a* remains inserted with the one or more stimulation tips 103 in contact with the clitoral region. Additionally, the adjustable straps 205 retains the position of the first shaft inside the first female's vagina or anus and maintains contact with the first female's clitoral region with the one or more stimulation tips 103 during thrusting of the second shaft 102*b* into and out of the vagina or anus of the second female. Although FIG. 2B shows use of two adjustable straps 205 on the first female's pair of thighs, in a further implementation, the first female and second female may each secure one adjustable strap 205 about one of their respective thighs to provide support to both users. In an alternative implementation, four adjustable straps 205 may be included to allow the first female and second female to secure one adjustable strap 205 per thigh, thus providing even more support during use of the stimulation device 100.

Figure 3:
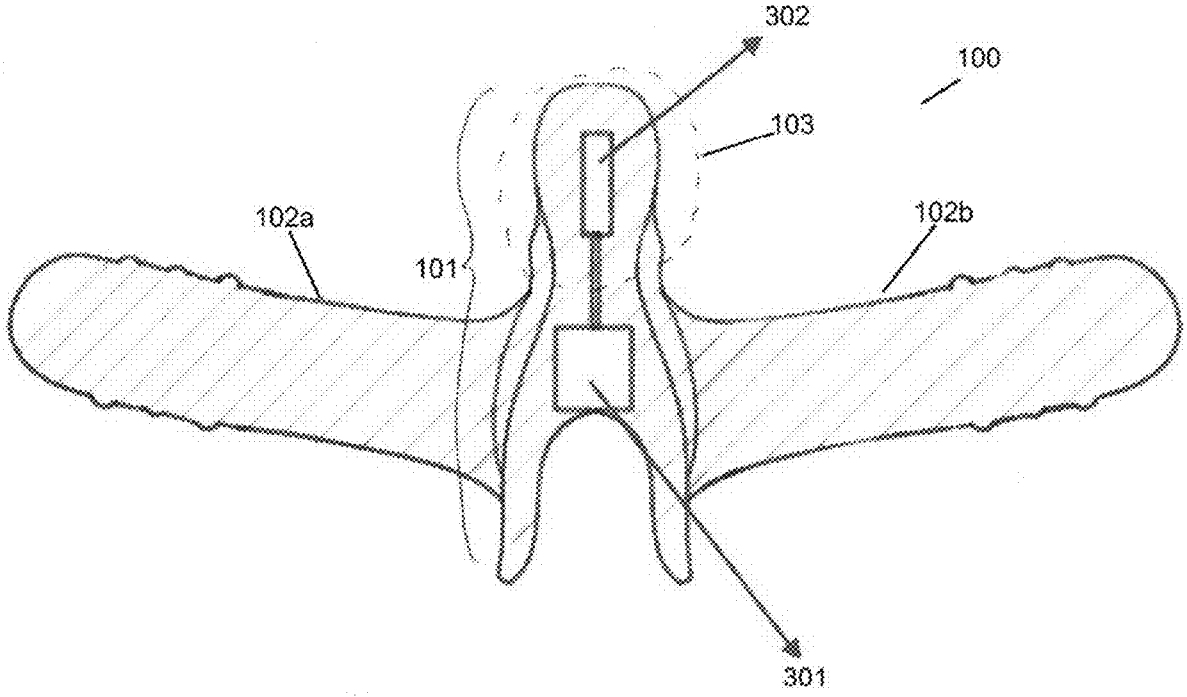
FIG. 3 is a cross section side view of the stimulation device in accordance with an implementation of the invention.

FIG. 3 illustrates the configuration of a power source 301 and a vibration motor 302 in accordance with an implementation of the stimulation device 100. The power source 301 delivers electrical current to the motor 302. The power source 301 is preferably disposed in the central portion 101 of the stimulation device 100. However, the power source 301 may be disposed in the first shaft 102*a*, the second shaft 102*b*, or the one or more stimulation tips 103 of the stimulation device 100. Alternatively, the power source may be positioned outside of the first shaft 102*a*, the second shaft 102*b*, the one or more stimulation tips 103, or the central portion 101 of the stimulation device 100. The power source may be an alternate current (AC) or direct current (DC) transformer. Alternatively, the power source 301 may be a battery that is removable and/or rechargeable. In a preferred implementation, the power source 301 is rechargeable lithium-ion battery.

The motor 302 is in electrical communication with the power source. The motor 302 is preferably disposed in the central portion 101 of the stimulation device 100; however, the motor 302 may be disposed in the first shaft 102*a*, the second shaft 102*b*, or the one or more stimulation tips 103. Further, the stimulation device 100 is not limited to having one motor 302, and may have additional motors to provide greater levels of stimulation. When the motor 302 is powered, i.e. the motor 302 receives an electrical current from the power source 301, the motor 302 vibrates or pulsates causing shafts 102*a*, 102*b* and the one or more stimulation tips 103 to vibrate or pulsate. The motor 302 may have selectively variable speeds of vibration or pulsation, variable durations of vibration or pulsation, variable intensities of vibration or pulsation, variable motions of vibration, or variable temperature characteristics. These variable features may be employed individually or simultaneously with one or more other features. For example, the speed of vibration or pulsation of the one or more stimulation tips 103 may be adjusted, while simultaneously adjusting the temperature of the one or more stimulation tips 103.

In another implementation, the central portion 101 may be hollow and adapted to receive at third-party motor supplied by the user. The third-party motor may be inserted by the user, and upon insertion, the motor may come into electrical communication with the power source 301 included with the stimulation device 100. In a further implementation, the central portion 101 may be hollow and adapted to receive a third-party motor that includes an integrated power source. A user of the stimulation device 100 may insert the third-party motor with the integrated power source into the stimulation device 100 to provide vibrations or pulsations to the one or more stimulation tips 103 and/or the shafts 102*a*, 102*b*.

In an additional implementation, an activation switch (not shown), such as an on/off button, may be positioned atop the surface of the central portion 101 or the one or more stimulation tips 103, although other positions would also be suitable. The activation switch may activate the power source, which in turn provides an electrical current to the motor 302. Additionally, the activation switch may include variable speed, duration, intensity, motion or temperature settings that causes the motor 302 to selectively adjust the speed of vibration or pulsation, duration of vibration or pulsation, intensity of vibration or pulsation, motion of vibration or temperature characteristics of shafts 102*a*, 102*b* or the one or more stimulation tips 103. In an alternative implementation, a user of the stimulation device 100 may twist or press down on the one or more stimulation tips 103 to activate the power source, which in turn provides an electrical current to the motor 302. Additionally, twisting or pressing down on the one or more stimulation tips may selectively adjust the speed of vibration or pulsation, duration of vibration or pulsation, intensity of vibration or pulsation, motion of vibration or temperature characteristics of shafts 102*a*, 102*b* or the one or more stimulation tips 103.

In a further implementation, the stimulation device 100 may include communication connection(s) that allows other devices to control the operation of the power source 301 and/or the motor 302. Communication connection(s) may include, but are not limited to, a radio frequency transmitter/receiver, a Bluetooth transmitter/receiver, an infrared port, a Universal Serial Bus (USB) connection, or other interfaces for connecting the stimulation device 100 to other devices. Example "other devices" include, but are not limited to, stimulation devices, sex toys, personal computers, hand-held or laptop devices, mobile devices (such as mobile phones, Personal Digital Assistants (PDAs), media players, and the like), consumer electronics, a and the like.

Communication connection(s) may include a wired connection or a wireless connection. A wireless connection to a smartphone, tablet, or similar computerized device may include a computer application that communicates with the power source 301 and/or the motor 302 via the wireless connection. Communication connection(s) may transmit and/or receive communications that allow a user to control the activation of the power source 301 and selectively adjust the speed of vibration or pulsation, duration of vibration or pulsation, intensity of vibration or pulsation, motion of vibration or temperature characteristics of shafts 102*a*, 102*b* or the one or more stimulation tips 103.

Figure 4A:
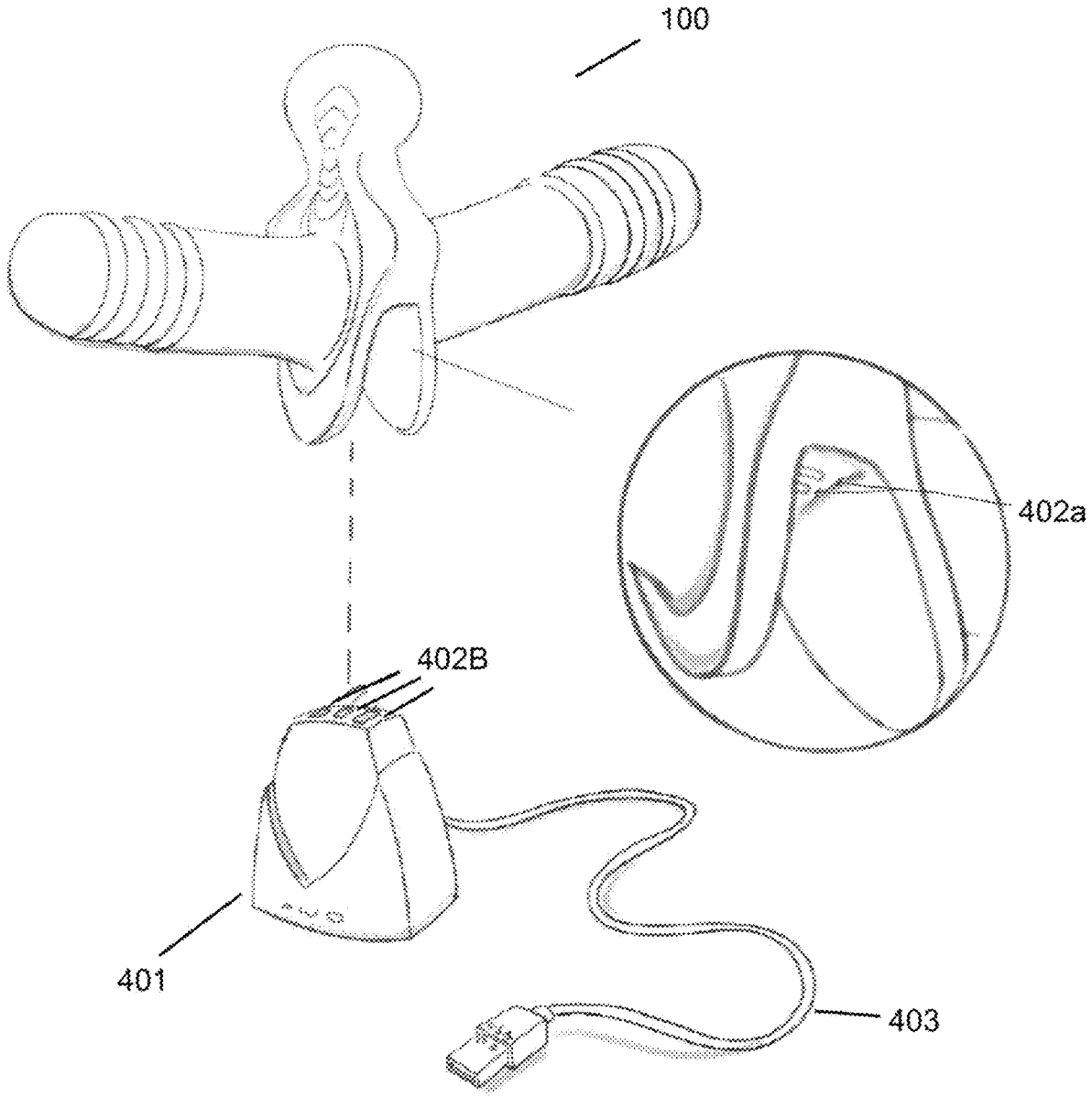
FIGS. 4A-4B are perspective views of a charger used in accordance with an implementation of the invention.
Figure 4B:
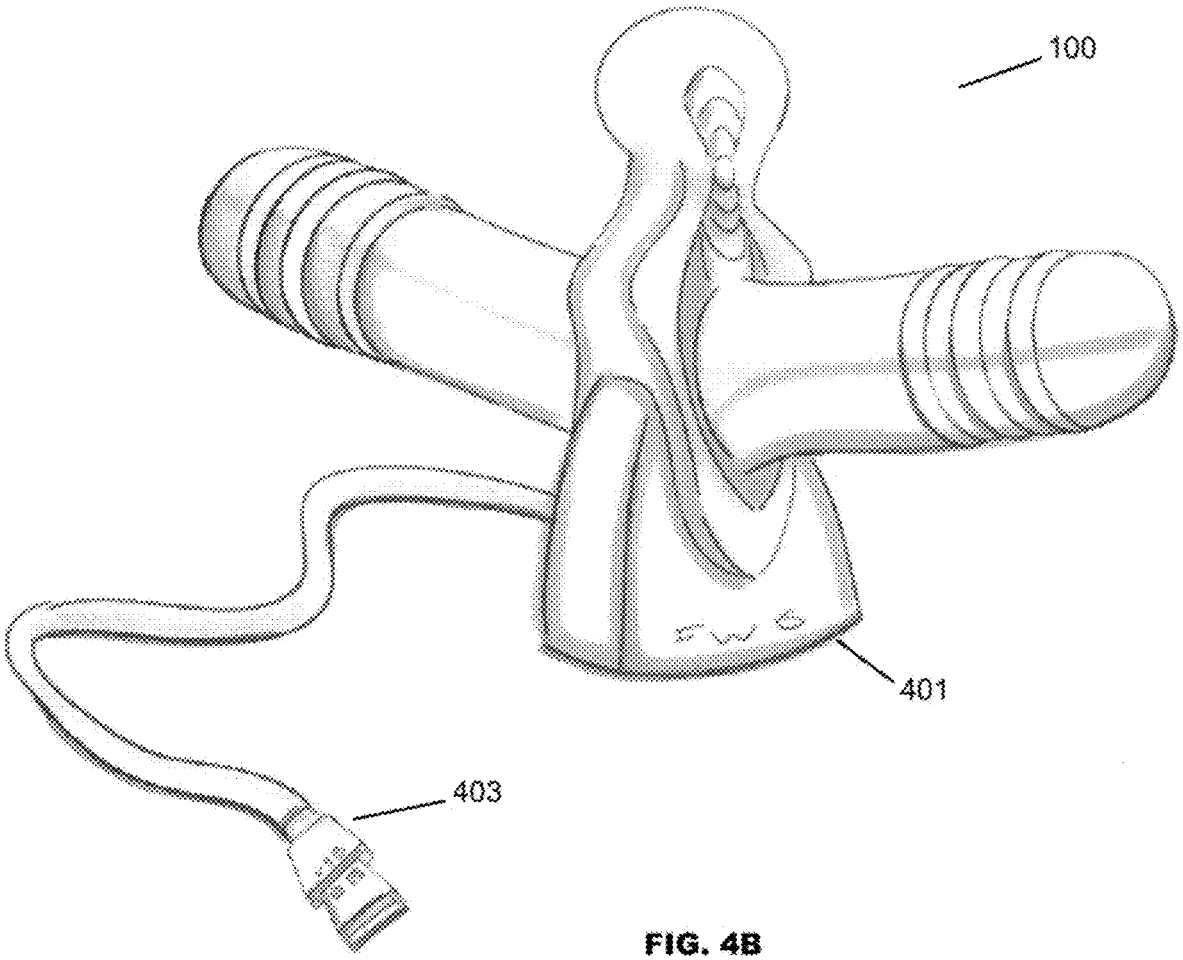

FIGS. 4A-4B illustrates an example implementation of a charger 401 that may provide power to the power source (not shown) of the stimulation device 100 or recharge the power source of the stimulation device 100. The charger 401 may be adapted to receive the stimulation device 100. More specifically, the central portion 101 of the stimulation device 100 may further include one or more connectors 402*a* that are configured to come into contact with one or more connectors 402*b* of the charger 401. Upon seating the stimulation device 100 onto the charger 401, the one or more connectors 402*a* may mate with the one or more connectors 402*b* of the charger 401, thereby generating an electrical connection between the stimulation device 100 and the charger 401. Accordingly, once connected, the charger 401 may provide power to the stimulation device 100, or recharge the power source of the stimulation device 100. Referring specifically to FIG. 4B, an electrical cord, such as a USB cord, DC power cord or AC power cord, may provide power to the charger 401 from an external source, which subsequently allows the charger 401 to provide power to the stimulation device 100 or recharge the power source of the stimulation device 100. In an alternative implementation, the stimulation device 100 may include a port (not shown) adapted to receive an electrical cord, such as a USB cord, DC power cord or AC power cord, to provide power to the stimulation device 100 or recharge the power source of the stimulation device 100.

Figure 5A:
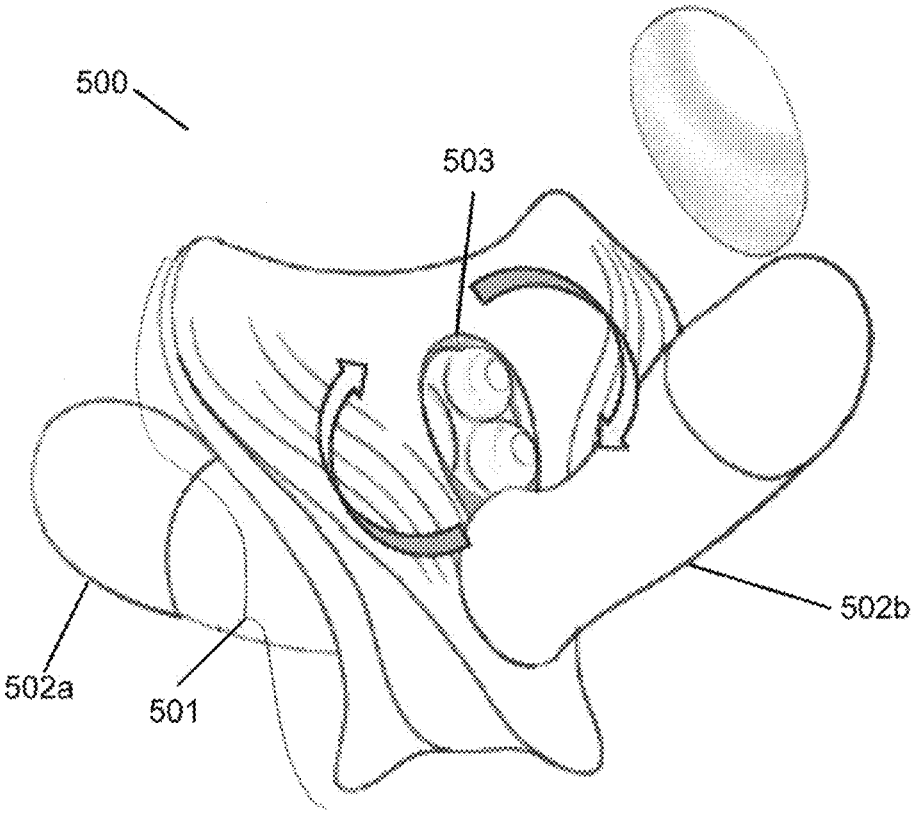
FIGS. 5A-5C are various views of the stimulation device in accordance with an alternative implementation of the invention.
Figure 5C:
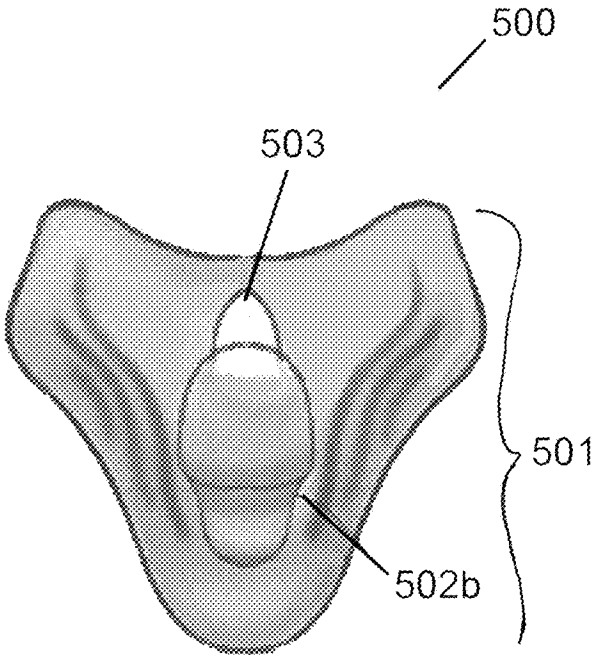
Figure 5B:
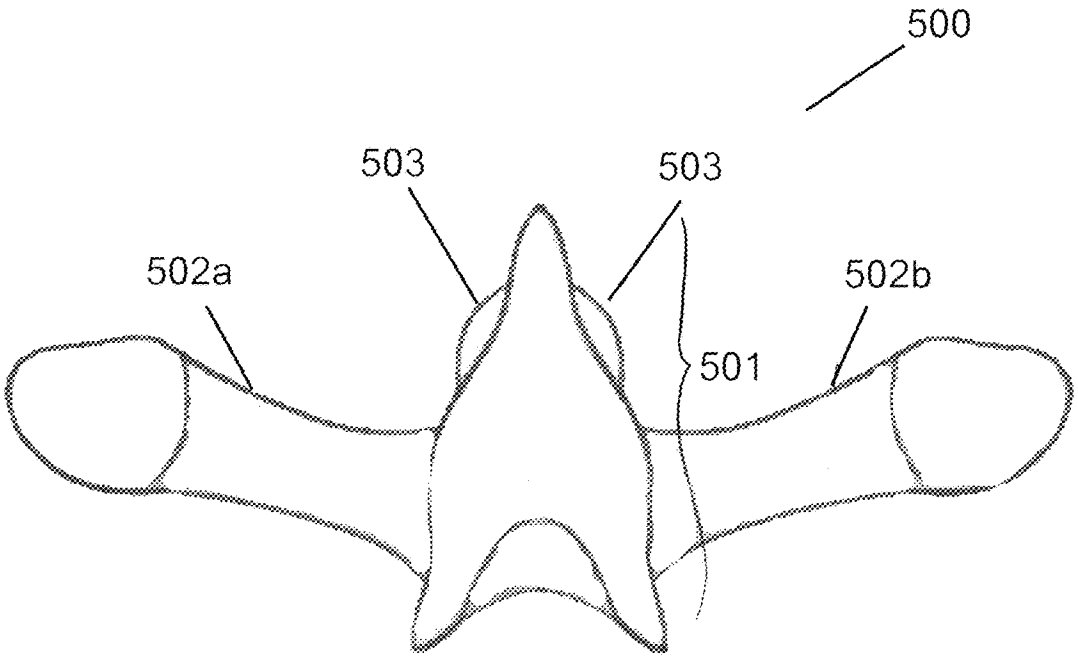

FIG. 5A-5C illustrates an alternative implementation of the stimulation device. The stimulation device 500 is shown including a central portion 501 having first and second opposite ends, a first shaft 502*a*, and a second shaft 502*b*. The first shaft 502*a* and the second shaft 502*b* extend from the first opposite end and the second opposite end, respectively. Both first opposite end and second opposite end refer to general areas and not to specific component parts. Further, the stimulation device 500 is bilaterally symmetrical, therefore, the first opposite end and the second opposite end are synonymous, and the use of the terms "first" or "second" are only used for the sake of clarity and to denote their use with respect to a "first" or "second" female user. However, in this example implementation, the first opposite end is depicted as the left side of the central portion 501, while the second opposite end is depicted as the right side of the central portion 501.

In this implementation, the central portion 501 has a generally triangular shaped body. The triangular shape allows the stimulation device 500 to adjust to a female's genital anatomy to facilitate its use as a synthetic appendage to the female genitalia. Additionally, the triangular shape facilitates the opening of the labia, which allows effortless contact with the clitoris. Upon insertion of shafts 502*a*, 502*b* into one or more female user's vagina or anus, the central portion 101 is configured to come into contact with the mons pubis region, perineal raphe region, anal region, and/or clitoral region of the genitalia of one or more female users. The outer surface of the central portion 501 includes a textured surface, such as nubs, ribs, protrusions, etc., intended to provide greater stimulation when contacted with a female's vagina or anus.

The central portion 501 may be made of a waterproof material. Additionally, the central portion 501 may be made of a pliable material, such as a rubber or suitable plastic, to allow for flexibility and comfort upon usage of the stimulation device and insertion of shaft 502*a*, 502*b* into the vagina or anus of one or more female users.

The central portion 501 further includes two stimulation tips 503 per opposite end that are integrated with the central portion 501. The stimulation tips 503 may provide a pleasurable vibrating motion or pulsating sensation to the clitoral region of a female's vagina. The stimulation tips 503 may be adapted to adjust temperature to provide a pleasurable heating or cooling sensation to the clitoral region of a female's vagina. Additionally, the stimulation tips 503 may be adapted to rotate in a circular motion to provide a pleasurable sensation to the clitoral region of a female's vagina. In this example implementation, the stimulation tips 503 are positioned to encapsulate the clitoris and provide a rotational massaging motion to the clitoris.

The stimulation tips 503 may be substantially spherical in shape. The outer surface of the stimulation tips 503 may include one or more textured surfaces, such as nubs, ribs, protrusions, etc., intended to provide greater stimulation when contacted with a female's clitoris. However, in this example implementation, the stimulation tips 503 have a generally smooth surface. The stimulation tips 503 may be made of a waterproof material. Additionally, the stimulation tips 503 may be made of a pliable material, such as a rubber or suitable plastic, to allow for flexibility and comfort upon usage of the stimulation device 100.

Still referring to FIGS. 5A-5C, a first shaft 502*a* and a second shaft 502*b* have an elongated shape and extend from the first opposite end and the second opposite end, respectively. As explained above, the stimulation device 500 is bilaterally symmetrical, therefore, the first shaft 502*a* and the second shaft 502*b* are synonymous, and the use of the terms "first" or "second" are only used for the sake of clarity and to denote their use with respect to a "first" or "second" female user. However, in this example implementation, the first shaft 502*a* is depicted as the left shaft, while the second shaft 502*b* is depicted as the right shaft.

Shafts 502*a*, 502*b* may provide a pleasurable vibrating motion or pulsating sensation to the vagina or anus of a female. In an additional implementation, shafts 502*a*, 502*b* may be adapted to adjust temperature to provide a pleasurable heating or cooling sensation to the vagina or anus of a female. In a further implementation, shafts 502*a*, 502*b* may have one or more apertures adapted to release a lubricant or another type of fluid to provide an additional pleasurable sensation to the vagina or anus of a female. The shape of shafts 502*a*, 502*b* may be generally cylindrical or phallic to simulate a human penis. The outer surface of shafts 502*a*, 502*b* may include one or more textured surfaces, such as nubs, ribs, protrusions, etc., intended to provide greater stimulation when inserted into a female's vagina or anus. However, in this example implementation, shafts 502*a*, 502*b* are substantially smooth to provide effortless insertion into a female's vagina or anus. Shafts 502*a*, 502*b* may be made of a waterproof material. Additionally, Shafts 502*a*, 502*b* may be made of a pliable material, such as a rubber or suitable plastic, to allow for flexibility and comfort upon usage of the stimulation device 500 and insertion of shafts 502*a*, 502*b* into the vagina or anus.

The first shaft 502*a* and the second shaft 502*b* are removable, and the central portion 501 may be configured to accept shafts of various sizes and configurations. Shafts 502*a*, 502*b* may be coupled to the central portion 501 by a threaded configuration, friction-fit arrangement, or with hardware such as fasteners, clasps, or the like.

Figure 6A:
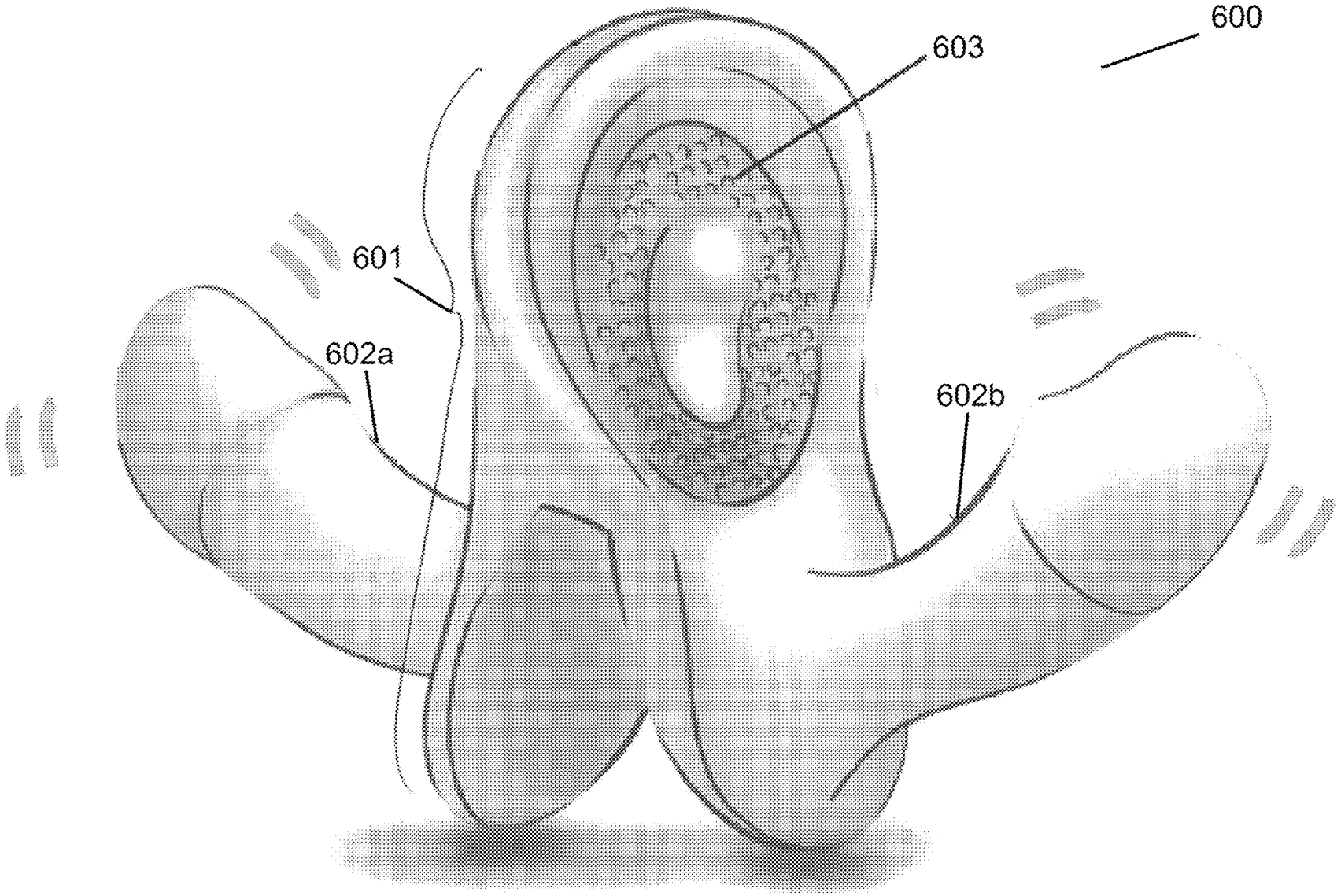
FIGS. 6A-6C are various views of the stimulation device in accordance with an alternative implementation of the invention.
Figure 6B:
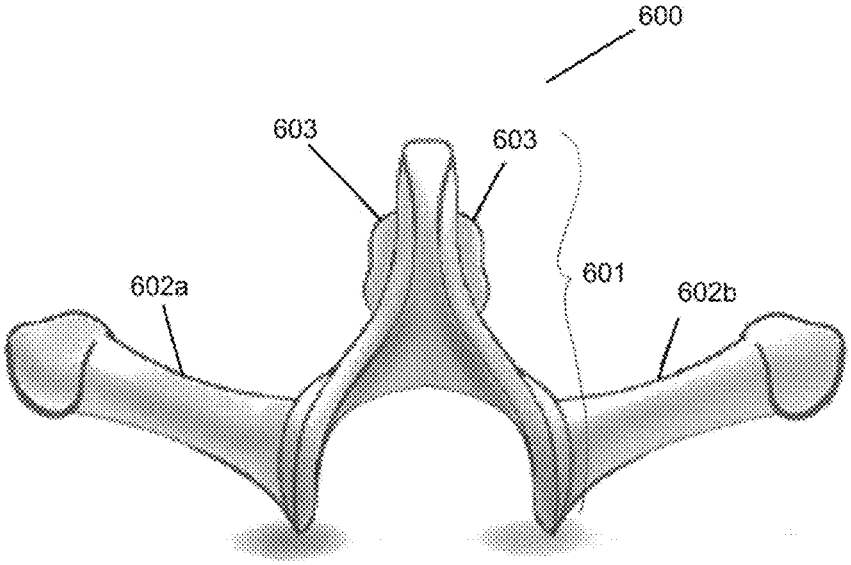
Figure 6C:
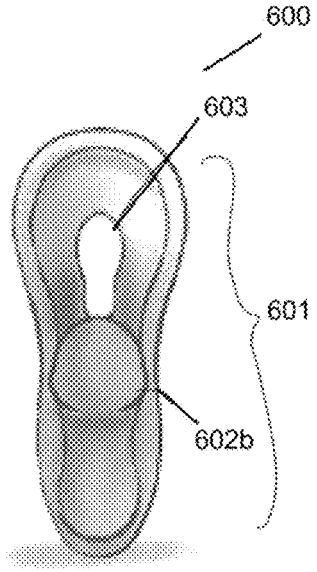

FIG. 6A-6C illustrates an alternative implementation of the stimulation device. The stimulation device 600 is shown including a central portion 601 having first and second opposite ends, a first shaft 602*a*, and a second shaft 602*b*. The first shaft 602*a* and the second shaft 602*b* extend from the first opposite end and the second opposite end, respectively. Both first opposite end and second opposite end refer to general areas and not to specific component parts. Further, the stimulation device 600 is bilaterally symmetrical, therefore, the first opposite end and the second opposite end are synonymous, and the use of the terms "first" or "second" are only used for the sake of clarity and to denote their use with respect to a "first" or "second" female user. However, in this example implementation, the first opposite end is depicted as the left side of the central portion 601, while the second opposite end is depicted as the right side of the central portion 601.

In this implementation, the central portion 601 has a generally "Y" shaped body. Upon insertion of shafts 602*a*, 602*b* into one or more female user's vagina or anus, the central portion 601 is configured to come into contact with the clitoral region of the vagina of one or more female users. The outer surface of the central portion 601 includes multiple textured surfaces, including protrusions that create a suction sensation. The outer surface of the central portion 601 is configured to hold the clitoral region while providing a suctioning effect to the female user's clitoris that is intended to provide greater stimulation.

The central portion 601 may be made of a waterproof material. Additionally, the central portion 601 may be made of a pliable material, such as a rubber or suitable plastic, to allow for flexibility and comfort upon usage of the stimulation device 600 and insertion of shaft 602*a*, 602*b* into the vagina or anus of one or more female users.

The central portion 601 further includes a stimulation tip 603 per opposite end that is integrated with the central portion 601. The stimulation tip 603 may provide a pleasurable vibrating motion or pulsating sensation to the clitoral region of a female's vagina. In this example implementation, the stimulation tip 603 provides a vibration or pulsation sensation to the clitoris while maintaining a suctioning sensation on the clitoris as provided by the textured surface.

The stimulation tip 603 may be substantially conical to facilitate suction on the clitoris. The outer surface of the stimulation tip 603 may include one or more textured surfaces, such as nubs, ribs, protrusions, etc., intended to provide greater stimulation when contacted with a female's clitoris. The stimulation tip 603 may be made of a waterproof material. Additionally, the stimulation tip 603 may be made of a pliable material, such as a rubber or suitable plastic, to allow for flexibility and comfort upon usage of the stimulation device 600.

Still referring to FIGS. 6A-6C, a first shaft 602*a* and a second shaft 602*b* have an elongated shape and extend from the first opposite end and the second opposite end, respectively. As explained above, the stimulation device 600 is bilaterally symmetrical, therefore, the first shaft 602*a* and the second shaft 602*b* are synonymous, and the use of the terms "first" or "second" are only used for the sake of clarity and to denote their use with respect to a "first" or "second" female user. However, in this example implementation, the first shaft 602*a* is depicted as the left shaft, while the second shaft 602*b* is depicted as the right shaft.

Shafts 602*a*, 602*b* may provide a pleasurable vibrating motion or pulsating sensation to the vagina or anus of a female. In an additional implementation, shafts 602*a*, 602*b* may be adapted to adjust temperature to provide a pleasurable heating or cooling sensation to the internal vagina or anus of a female. In a further implementation, shafts 602*a*, 602*b* may have one or more apertures adapted to release a lubricant or another type of fluid to provide an additional pleasurable sensation to the vagina or anus of a female. The shape of shafts 602*a*, 602*b* may be generally phallic to simulate a human penis. The outer surface of shafts 602*a*, 602*b* may include one or more textured surfaces, such as nubs, ribs, protrusions, etc., intended to provide greater stimulation when inserted into a female's vagina or anus. However, in this example implementation, shafts 602*a*, 602*b* are substantially smooth to provide effortless insertion into a female's vagina or anus. Shafts 602*a*, 602*b* may be made of a waterproof material. Additionally, Shafts 602*a*, 602*b* may be made of a pliable material, such as a rubber or suitable plastic, to allow for flexibility and comfort upon usage of the stimulation device 600 and insertion of shafts 602*a*, 602*b* into the vagina or anus.

Figure 7A:
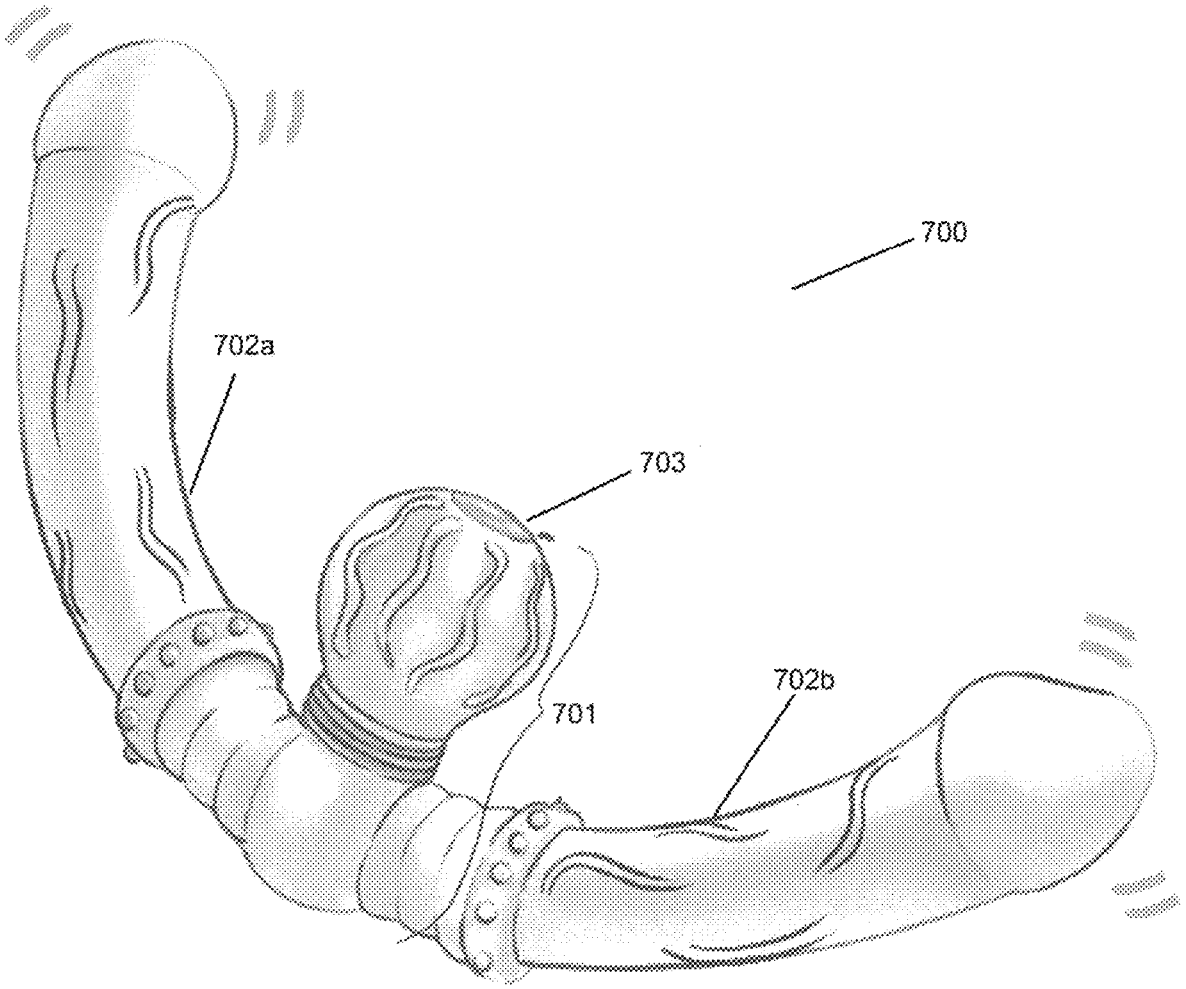
FIGS. 7A-7C are various views of the stimulation device in accordance with an alternative implementation of the invention.
Figure 7B:
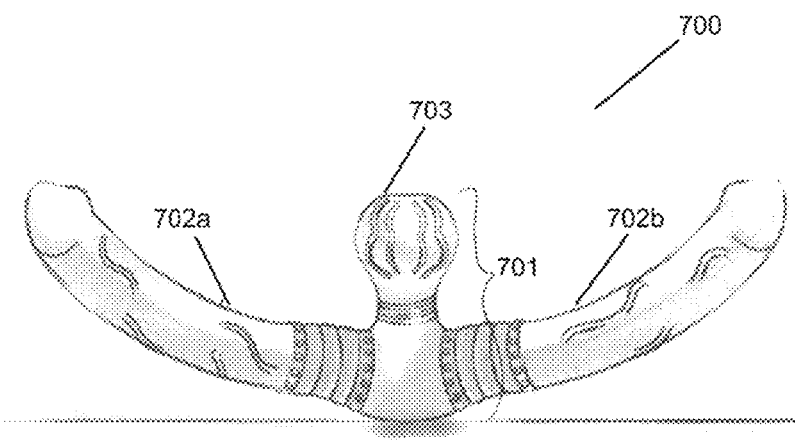
Figure 7C:
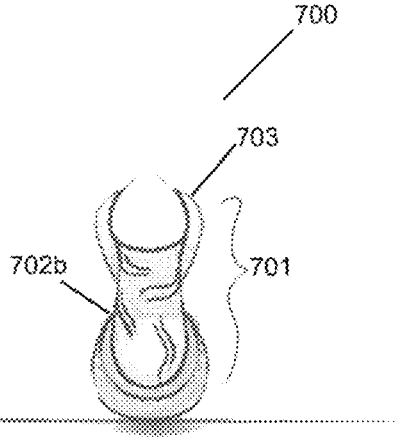

FIG. 7A-7C illustrates an alternative implementation of the stimulation device. The stimulation device 700 is shown including a central portion 701 having first and second opposite ends, a first shaft 702*a*, and a second shaft 702*b*. The first shaft 702*a* and the second shaft 702*b* extend from the first opposite end and the second opposite end, respectively. Both first opposite end and second opposite end refer to general areas and not to specific component parts. Further, the stimulation device 700 is bilaterally symmetrical, therefore, the first opposite end and the second opposite end are synonymous, and the use of the terms "first" or "second" are only used for the sake of clarity and to denote their use with respect to a "first" or "second" female user. However, in this example implementation, the first opposite end is depicted as the left side of the central portion 701, while the second opposite end is depicted as the right side of the central portion 701.

In this implementation, the central portion 701 has a generally "T" shaped body. Upon insertion of shafts 702*a*, 702*b* into one or more female user's vagina or anus, the central portion 701 is configured to come into contact with the clitoral region of the vagina of one or more female users. The outer surface of the central portion 701 includes various textured surfaces intended to provide greater stimulation upon insertion of shafts 702*a*, 702*b* and upon contact of the central portion 701 with a female's clitoris.

The central portion 701 may be made of a waterproof material. Additionally, the central portion 701 may be made of a pliable material, such as a rubber or suitable plastic, to allow for flexibility and comfort upon usage of the stimulation device and insertion of shaft 702*a*, 702*b* into the vagina or anus of one or more female users.

The central portion 701 further includes a stimulation tip 703 that is coupled to central portion 701. The stimulation tip 703 is removable and interchangeable with other types of stimulation tips. The stimulation tip 703 may provide a pleasurable vibrating motion or pulsating sensation to the clitoral region of a female's vagina. The stimulation tip 703 may be adapted to adjust temperature to provide a pleasurable heating or cooling sensation to the clitoral region of a female's vagina. In this example implementation, the motor (not shown) of the stimulation device 700 is disposed within the stimulation tip 703 and is thus removable due to the stimulation tip 703 being removable.

The stimulation tip 703 may be substantially spherical in shape. The outer surface of the stimulation tip 703 includes a ribbed surface intended to provide greater stimulation when contacted with a female's clitoris. The stimulation tip 703 may be made of a waterproof material. Additionally, the stimulation tip 703 may be made of a pliable material, such as a rubber or suitable plastic, to allow for flexibility and comfort upon usage of the stimulation device 700.

Still referring to FIGS. 7A-7C, a first shaft 702*a* and a second shaft 702*b* have an elongated shape and extend from the first opposite end and the second opposite end, respectively. As explained above, the stimulation device 700 is bilaterally symmetrical, therefore, the first shaft 702*a* and the second shaft 702*b* are synonymous, and the use of the terms "first" or "second" are only used for the sake of clarity and to denote their use with respect to a "first" or "second" female user. However, in this example implementation, the first shaft 702*a* is depicted as the left shaft, while the second shaft 702*b* is depicted as the right shaft.

Shafts 702*a*, 702*b* may provide a pleasurable vibrating motion or pulsating sensation to the vagina or anus of a female. In an additional implementation, shafts 702*a*, 702*b* may be adapted to adjust temperature to provide a pleasurable heating or cooling sensation to the vagina or anus of a female. In a further implementation, shafts 702*a*, 702*b* may have one or more apertures adapted to release a lubricant or another type of fluid to provide an additional pleasurable sensation to the vagina or anus of a female. The shape of shafts 702*a*, 702*b* may be generally phallic to simulate a human penis. The outer surface of shafts 102*a*, 102*b* may include one or more textured surfaces, such as nubs, ribs, protrusions, etc., intended to provide greater stimulation when inserted into a female's vagina or anus. In this example implementation, shafts 702*a*, 702*b* have a substantially ribbed surface with a dotted texture towards the base of shafts 702*a*, 702*b*. The dotted texture simulates the hymen and internal walls of a female's vagina. Shafts 702*a*, 702*b* may be made of a waterproof material. Additionally, Shafts 702*a*, 702*b* may be made of a pliable material, such as a rubber or suitable plastic, to allow for flexibility and comfort upon usage of the stimulation device 700 and insertion of shafts 702*a*, 702*b* into the vagina or anus.

The first shaft 702*a* and the second shaft 702*b* are removable, and the central portion 701 may be configured to accept shafts of various sizes and configurations. Shafts 702*a*, 702*b* may be coupled to the central portion 701 by a threaded configuration, friction-fit arrangement, or with hardware such as fasteners, clasps, or the like.

Figure 7D:
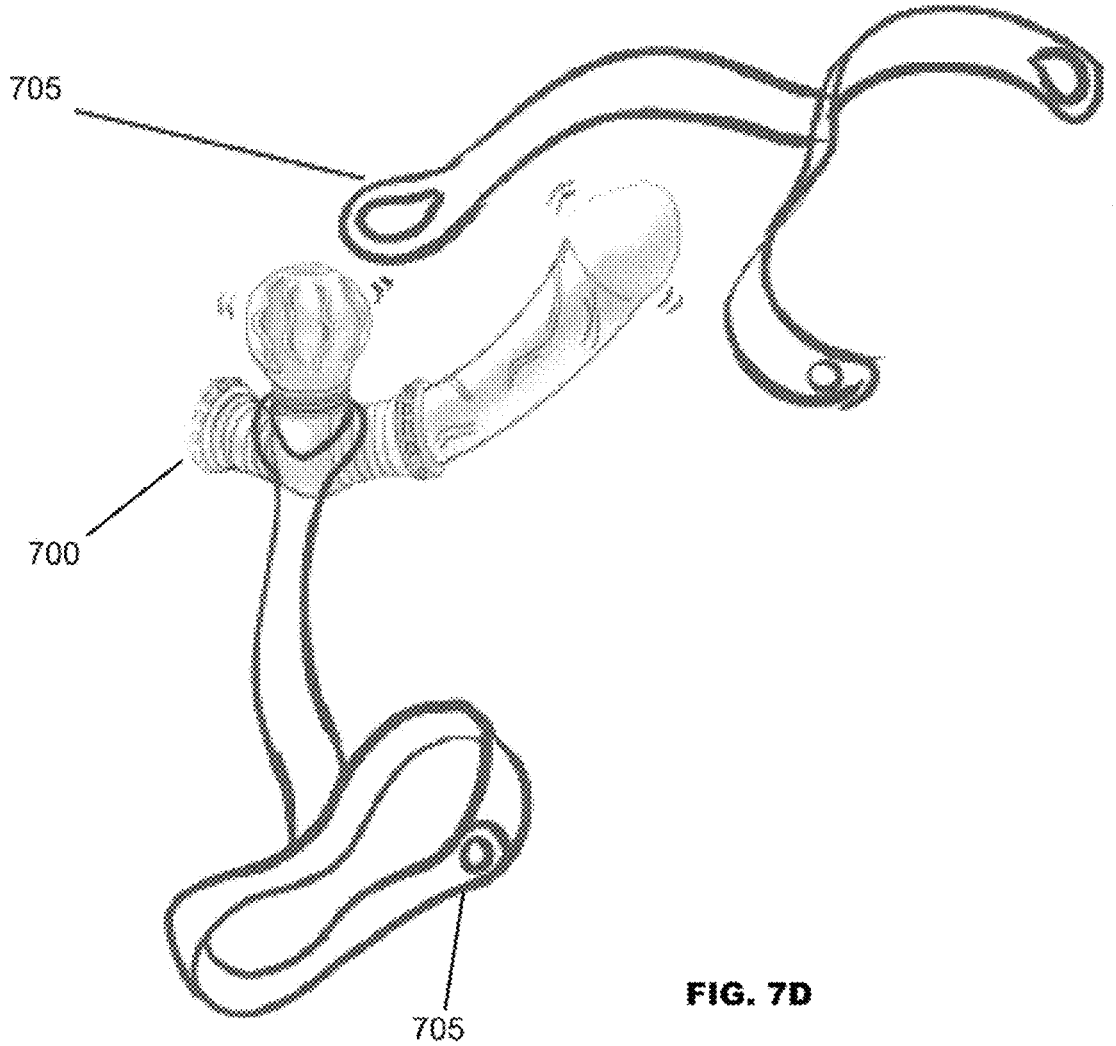
FIG. 7D is a perspective view of the stimulation device including adjustable straps in accordance with an alternative implementation of the invention.
Figure 7E:
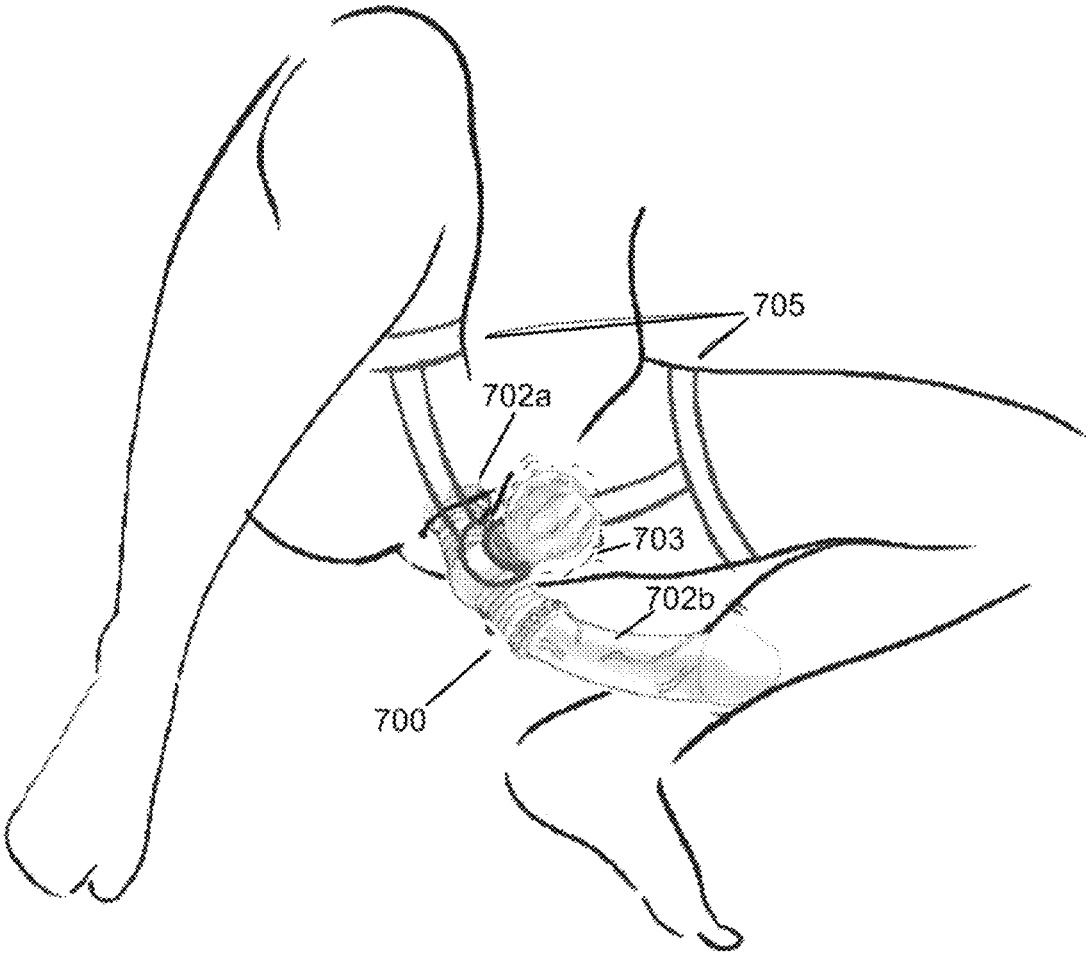
FIG. 7E is a perspective view of the stimulation device applied to a user via the adjustable straps in accordance with an alternative implementation of the invention.

In a further implementation, FIGS. 7D-7E illustrate an example implementation of the stimulation device 700 that may include one or more adjustable straps 705. The one or more adjustable straps 705 may be removably coupled to the central portion 701 of the stimulation device 700. The adjustable straps 705 may be made of nylon, Velcro, rubber (elastic band), plastic, or the like.

FIG. 7E illustrates the one or more adjustable straps 705 in use in accordance with the example implementation described above with respect to FIG. 7C. The adjustable straps 705 may be secured about the thigh of the first or second female's leg. The adjustable straps 705 support the stimulation device 700 so that, upon insertion of the first shaft 702*a* into the first female's vagina or anus, the first shaft 702*a* remains inserted with the stimulation tip 703 in contact with the clitoral region. Additionally, the adjustable strap 705 retains the position of the first shaft 702*a* inside the first female's vagina or anus and maintains contact of the first female's clitoral region with the stimulation tip 703 during thrusting of the second shaft 702*b* into and out of the vagina or anus of the second female. Although FIG. 7C shows use of two adjustable straps 705 on the first female's pair of thighs, in a further implementation, the first female and second female may each secure one adjustable strap 705 about one of their respective thighs to provide support to both users. In an alternative implementation, four adjustable straps 705 may be included to allow the first female and second female to secure one adjustable strap 705 per thigh, thus providing even more support during use of the stimulation device 700.

Any reference in this specification to "one implementation," "an implementation," an "example implementation," etc., means that a particular feature, structure, or characteristic described in connection with the implementation is included in at least one implementation of the invention. The appearances of such phrases in various places in the specification are not necessarily referring to the same implementation. In addition, any elements or limitations of any invention or implementation thereof disclosed herein can be combined with any and/or all other elements or limitations (individually or in any combination) or any invention or implementation thereof disclosed herein, and all such combinations are contemplated with the scope of the invention without limitation thereto.

It should be understood that the examples and implementations described herein are for illustrative purposes only and that various modifications or changes in light thereof will be suggested to persons skilled in the art and are to be included within the spirit and purview of this application.

I claim:

1. A sexual stimulation device, comprising:

a central portion having first and second opposite ends;

a first shaft extending from the first opposite end;

a second shaft extending from the second opposite end;

one or more stimulation tips extending from the central portion;

at least one vibration motor disposed within a hollow cavity of the central portion, the at least one vibration motor being selectively removable from the hollow cavity;

wherein the at least one vibration motor imparts a vibrational motion on at least one of the first shaft, second shaft, and/or one or more stimulation tips;

wherein the first shaft is adapted for insertion into a vagina or anus of a first person;

wherein the second shaft is adapted for insertion into a vagina or anus of a second person; and wherein the one or more stimulation tips are adapted for stimulating a clitoris of one or both of the first and second persons if the first and/or second persons are female.

2. The sexual stimulation device of claim 1, wherein at least one of the first shaft, second shaft, and/or one or more stimulation tips are releasably attached to the central portion.

3. The sexual stimulation device of claim 1, wherein one or both of the first and second shafts is shaped to simulate a human penis.

4. The sexual stimulation device of claim 1, wherein one or both of the first and second shafts has peripheral protrusions.

5. The sexual stimulation device of claim 1, wherein one or both of the first and second shafts has peripheral ribs.

6. The sexual stimulation device of claim 1, wherein at least one of the first shaft, second shaft, one or more stimulation tips, and/or central portion are constructed of a pliable material.

7. The sexual stimulation device of claim 1, wherein the at least one vibration motor is powered by a power source.

8. The sexual stimulation device of claim 7, wherein the power source is disposed within one of the first shaft, second shaft, one or more stimulation tips, and/or central portion.

9. The sexual stimulation device of claim 7, wherein the power source is external to the first shaft, second shaft, one or more vibrational tips, and/or central portion.

10. The sexual stimulation device of claim 7, wherein the power source comprises a rechargeable battery.

11. The sexual stimulation device of claim 7, wherein the power source comprises an alternate current or direct current transformer.

12. The sexual stimulation device of claim 7, wherein at least one of said one or more stimulation tips is substantially spherically shaped.

13. The sexual stimulation device of claim 1, further comprising an adjustable strap.

14. The sexual stimulation device of claim 1, wherein the first shaft and second shaft have different dimensions.

15. The sexual stimulation device of claim 14, wherein the first shaft and second shaft have different diameters.

16. The sexual stimulation device of claim 14, wherein the first shaft and second shaft have different lengths.

17. The sexual stimulation device of claim 1, wherein one or both of the first shaft and the second shaft have a substantially elongated shape.

18. The sexual stimulation device of claim 1, wherein one or both of the first shaft and the second shaft have a substantially curved shape.

* * * * *